US012655733B2

(12) United States Patent
Harding

(10) Patent No.: US 12,655,733 B2
(45) **Date of Patent: *Jun. 16, 2026**

(54) METHOD AND SYSTEM FOR OIL RECOVERY USING SOLVENT-ASSISTED ELECTRIC HEATING

(71) Applicant: Thomas Grant Harding, Calgary (CA)

(72) Inventor: Thomas Grant Harding, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 19/033,205

(22) Filed: Jan. 21, 2025

(65) Prior Publication Data

US 2025/0163787 A1 May 22, 2025

Related U.S. Application Data

(63) Continuation of application No. 18/620,451, filed on Mar. 28, 2024, now Pat. No. 12,241,351.

(60) Provisional application No. 63/504,463, filed on May 26, 2023.

(51) Int. Cl.

| | |
|---|---|
| ***E21B 43/241*** | (2006.01) |
| ***E21B 36/04*** | (2006.01) |
| ***E21B 43/24*** | (2006.01) |
| ***E21B 47/06*** | (2012.01) |
| ***E21B 47/07*** | (2012.01) |

(52) U.S. Cl.

CPC ..... *E21B 43/241* (2013.01); *E21B 36/04* (2013.01); *E21B 43/2401* (2013.01); *E21B 47/06* (2013.01); *E21B 47/07* (2020.05)

(58) Field of Classification Search

CPC .... E21B 43/2401; E21B 43/241; E21B 43/34; E21B 47/06; E21B 36/04

See application file for complete search history.

(56) References Cited

U.S. PATENT DOCUMENTS

| | | | | |
|---|---|---|---|---|
| 12,241,351 | B2 * | 3/2025 | Harding | E21B 43/34 |
| 2003/0015458 | A1 * | 1/2003 | Nenniger | E21B 43/34 166/266 |
| 2011/0253368 | A1 * | 10/2011 | Banerjee | E21B 43/2408 166/272.3 |
| 2020/0378228 | A1 * | 12/2020 | Eichhorn | E21B 47/07 |

* cited by examiner

*Primary Examiner* — Brad Harcourt

(74) *Attorney, Agent, or Firm* — Bennett Jones LLP

(57) ABSTRACT

Embodiments herein generally relate to a method and system for oil recovery using solvent-assisted electric heating. In at least one example, the method comprises A method for oil production using solvent-assisted electric heating, comprising conveying liquid solvent into a subsurface formation; operating at least one downhole electric heater to vaporize the solvent in-situ, the at least one downhole electric heater being operated in a temperature range that is: (i) above the vaporization temperature of the solvent; and (ii) below the steam saturation temperature of the reservoir; conveying a mixture comprising oil and solvent from the subsurface formation to a separation subsystem; and separating, using the separation subsystem, the oil from the solvent.

20 Claims, 10 Drawing Sheets

METHOD AND SYSTEM FOR OIL RECOVERY USING SOLVENT-ASSISTED ELECTRIC HEATING

CROSS-REFERENCE TO RELATED APPLICATION(S)

This application is a continuation of U.S. patent application Ser. No. 18/620,451 filed on Mar. 28, 2024, which claims the benefit of priority to U.S. Provisional Patent Application No. 63/504,463 filed on May 26, 2023. The entire contents of each of these applications are incorporated herein by reference in their entirety.

FIELD

Various embodiments are described herein that generally relate to oil recovery technology, and in particular, to a method and system for oil recovery using solvent-assisted electric heating.

BACKGROUND

The following is not an admission that anything discussed below is part of the prior art or part of the common general knowledge of a person skilled in the art.

Steam-assisted gravity drainage ("SAGD") is a widely used process for producing and recovering bitumen from oil sands. SAGD involves generating high-temperature steam using above surface water boilers. The high-temperature steam is injected underground, via an injection well, such as to cause subterranean formation heating and melting of bitumen. The melted bitumen drains (e.g., under the influence of gravity), to a lower production well, which conveys the bitumen and condensed steam above surface for downstream processing.

SAGD, however, suffers from a number of critical drawbacks. First, SAGD is an energy-intensive process, and generates substantial carbon dioxide ($CO_2$) emissions. This is owing, in large part, to the above surface water boilers, which are used for generating high pressure steam. In particular, these boilers demand high energy input to generate the high pressure steam. In many cases, the water boilers require burning natural gas in order to heat the water, which results in significant $CO_2$ emissions.

Second, the SAGD process suffers from inefficiencies, e.g., heat losses. By way of non-limiting examples, these include inefficiencies in the water boilers, where significant heat escapes with flue gas. Additionally, the surface lines and wellbores experience non-negligible heat losses. To that end, a substantial portion of the energy injected as steam vapor is returned to surface as liquid steam condensate, which is at high temperatures and contains substantial energy. As well, the exchange of heat above surface, as between the produced steam condensate on one hand, and boiler feed water on the other, results in heat losses due to inefficiency of the heat exchange.

Third, high capital and operating costs are necessary to establish and maintain SAGD operations. These costs result, not only from expensive water boiler and steam generation equipment—but also from the large vessels SAGD requires to separate produced oil (e.g., bitumen) from water. Substantial capital and operating costs are also required for treating produced water in order to recycle the water for re-use. These significant costs require economies of scale to make SAGD economically feasible. In turn, it is difficult to construct and deploy small SAGD plants, e.g., to accommodate small reservoirs.

In view of the foregoing, it is understood that SAGD is generally an economically, environmentally, and socially unsustainable process. Moreover, it is believed that at least the economics of SAGD is gradually becoming more marginal as penalties associated with carbon dioxide ($CO_2$) emissions gradually increase. An alternative process for oil recovery and production is therefore desired.

SUMMARY

According to one broad aspect, there is provided a method for oil production, comprising: operating at least one downhole electric heater to vaporize liquid solvent conveyed into a subsurface formation, the at least one downhole electric heater being operated in a temperature range that is: (i) above the vaporization temperature of the solvent; and (ii) below the steam saturation temperature of the subsurface formation, wherein operating the at least one downhole electric heater produces a mixture comprising oil and solvent, the mixture being further separable to separate the oil from the solvent, such as to produce oil.

In another broad aspect, there is provided a system for oil production, comprising: at least one downhole electric heater operable to vaporize liquid solvent conveyed into a subsurface formation, the at least one electric heater operable in a temperature range that is: (i) above the vaporization temperature of the solvent; and (ii) below the steam saturation temperature of the subsurface formation, wherein operating the at least one downhole electric heater in the subsurface formation produces a mixture comprising oil and solvent, the mixture being further separable to separate the oil from the solvent, such as to produce oil.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

Further aspects and features of the example embodiments described herein will appear from the following description taken together with the accompanying drawings.

DESCRIPTION OF VARIOUS EMBODIMENTS

Embodiments herein generally relate to a method and system for oil recovery using solvent-assisted electric heating. In some examples, the disclosed embodiments are used for producing and recovering heavy oil, as well as heavy crude oils (e.g., bitumen) as found in oil sands.

I. General Overview

Figure 1A:
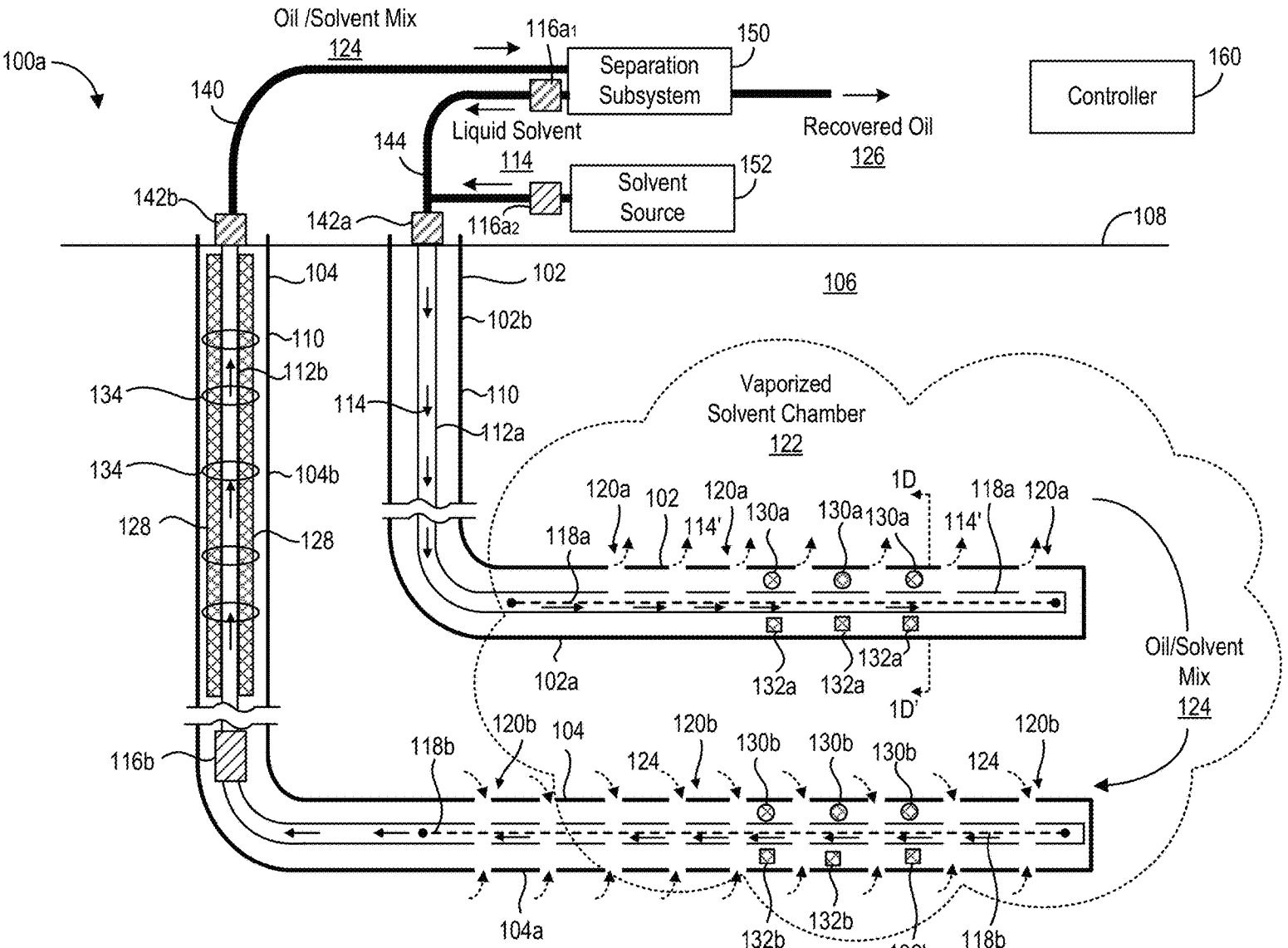
FIG. 1A is an example system for oil production and recovery using solvent-assisted electric heating.

Reference is now made to FIG. 1A, which shows an example system (100*a*) for oil production and recovery using solvent-assisted electric heating.

System (100*a*) can be used for production and recovery of oils from a subsurface formation (106). As used herein, "oil" can refer to heavy oils, bitumen and/or other extra heavy crude oils, as the terms are known and defined in the art. In some examples, formation (106) is a hydrocarbon formation, or otherwise, any oil reservoir.

As shown, analogous to conventional SAGD systems, system (100*a*) includes a pair of wells located in the formation (106). The well pair includes an upper injection well (102), and a lower production well (104). The well pair can be, for example, drilled or bored into formation (106).

Each well (102), (104) includes a corresponding horizontal well portion (102*a*), (104*a*), and a vertical well portion (102*b*), (104*b*). The well portions are fluidly coupled together. Further, the vertical well portions (102*b*) (104*b*) connect each well to above ground (108).

It is understood that the horizontal well portions (102*a*), (104*a*) may not be exactly horizontal, but can be oriented at an angle relative to a horizontal axis. Similarly, the vertical well portions (102*b*), (104*b*) may also be at an angle relative to a vertical axis.

In exemplified embodiments, each well (102), (104) includes an outer casing (110), which surrounds and encapsulates a respective inner tubing (112). As used herein, the inner tubing (112) may also be referred to, more generally, as a "conveyance structure". In other examples, the wells have any other suitable configuration known in the art.

In operation, injection well (102) receives a supply of liquid solvent (114). The liquid solvent (114) is received from one or more of: (i) a separation subsystem (150), and (ii) a solvent source (152) (e.g., a repository of make-up solvent). These components are explained in further detail below. In some examples, the solvent source (152) may not be necessary through all stages of use of the system (100*a*).

As also explained below, system (100*a*) can use various types of liquid solvents (114). For example, solvent (114) can include propane, butane, pentane or dimethyl ether. The solvent can also include a mixture of two or more solvents (e.g., propane and butane).

Liquid solvent (114) can be pumped into the injection well (102), via solvent pumps (116*a*). In some examples, separate solvent pumps (116*a*1), (116*a*2) are provided respectively for each of the separation subsystem (150) and solvent source (152). In other examples, a single solvent pump (116*a*) is provided for each component. As discussed below, solvent pumps (116*a*) may be controllable, in some cases, to vary the solvent injection rate into formation (106).

In some examples, system (100*a*) also includes a well head control valve (142*a*), which connects above surface pipelines (144) to the inner injection tubing (112*a*).

Continuing with reference to FIG. 1A, liquid solvent (114)—which is pumped into the injection well (102)—is conveyed through, and by, the injection tubing (112*a*) into formation (106). Injection tubing (112*a*) conveys solvent (114) through the vertical well portion (102*b*), and into the sub-surface horizontal well portion (102*a*).

Horizontal well portion (102*a*) is lined with a plurality of slots (120*a*) (e.g., ports), which allow the solvent (114) to exit into the formation (106). The slots (120*a*) extend through the outer casing (110) and inner injection tubing (112*a*) and allow the solvent (114) to exit the inner injection tubing (112*a*).

Significantly, prior to exiting the injection well (102), solvent (114) is vaporized from liquid phase into vapor phase. In this manner, vaporized solvent (114') rises out of the injection well (102), and into formation (106).

As shown, the vaporization of the liquid solvent (114) is effected by one or more downhole electric heaters (118*a*), associated with the inner tubing (112*a*) of injection well (102) (e.g., represented by dashed lines in FIG. 1A).

To that end, reference herein to electric heater (118*a*) in the singular is only for ease of reference. It is understood that any such singular reference encompasses cases involving two or more electric heaters (e.g., a plurality of electric heaters).

More generally, electric heater (118*a*) is operated to apply heat to the liquid solvent (114) conveyed by injection tubing (112*a*). This allows the electric heater (118*a*) to apply in-situ vaporization to the solvent (114)—e.g., in-situ inside formation (106)—to generate vaporized solvent (114').

As some solvents have a relatively low latent heat of vaporization (LHV), it may not be practical nor advisable to vaporize the solvents above surface. This is because the solvents will cool (e.g., condense) enough during transit in the vertical section of the injection well to cause a significant amount of the solvent to condense by the time it arrives at the horizontal well portion (102*a*). It can also be more difficult and expensive to otherwise pump compressed vapor solvent downhole. Accordingly, the use of electric heaters for in-situ vaporization of solvent (114) allows the solvent to be carried down in liquid form, until it reaches the horizontal well portion (102*a*).

Any type of electric heater (118*a*) can be used in system (100*a*). In some examples, the electric heater (118*a*) is a resistive electric heater.

The electric heater can receive power from one or more power sources, e.g., via power supply line(s). The power supply line(s) may extend from an above surface power source, through the vertical section of the well (102*b*) and extend into the horizontal section of the well (102*a*) (e.g., via injection well (102)), to couple to electric heater (118*a*).

Electric heater (118*a*) can also be disposed at any location with respect to inner tubing (112*a*), of injection well (102). For instance, as exemplified in FIG. 1D, the electric heater (118*a*) can be located, fully or partially, within the inner tubing (112*a*). This allows the electric heater (118*a*) to directly contact the flowing liquid solvent (114) and apply direct in-situ heat.

In other examples, electric heater (118*a*) is located, fully or partially, in a space between the outer casing (110) and inner tubing (112*a*), of injection well (102). In still other examples, electric heater (118*a*) is located fully or partially outside the outer casing (110).

In examples where multiple electric heaters (118*a*) are provided, the electric heaters (118*a*) can be located in the same or different locations, relative to the inner injection tubing (112*a*). Further, the multiple electric heaters (118*a*) may have different power ratings and may be controlled at different temperatures.

With continued reference to FIG. 1A, the electric heater (118*a*) may extend along a substantial portion of the horizontal injection well portion (102*a*). In this manner, the electric heater (118*a*) is referred to herein as an "elongated electric heater" (or otherwise, an "elongated resistive electric heater"). This ensures uniform heating is applied to the liquid solvent (114) travelling and exiting from any section of the horizontal well portions (102*a*).

In some examples, the elongate electric heater (118*a*) extends along an axis coaxial with the axis of extension of injection well (102), or at least, the well's inner tubing (112*a*), e.g., along the horizontal well portion. In at least one example, the elongate electric heater (118*a*) extends for a length that is equal, or substantially equal, to the segment of the inner tubing (112*a*) that includes slots (120*a*). It is also possible that the elongate heater (118*a*) is segmented into two or more heaters (118*a*) positioned sequentially.

In at least one example, a first end of the elongate electric heater (118*a*) is located at the bottom of the vertical portion (102*b*), of the injection well (102). This allows at least some of the solvent (114) to be in the vapor phase as the solvent (114) enters the horizontal portion (102*a*). The electric heater (118*a*) can then extend to the end of the horizontal well portion (102*a*) to complete the vaporization of the solvent (114), as well as to provide uniform temperature along the horizontal portion (102*a*) for entry of solvent into the formation.

Still referring to FIG. 1A, the injected high-temperature vaporized solvent (114') rises and enters formation (106), and in turn, generates a vaporized solvent chamber (122). The vaporized solvent chamber (112) grows upwardly, owing to the much lower density of the vapor solvent than reservoir liquids (e.g., oil and/or water).

Within the vaporized solvent chamber (122), the vaporized solvent (114') begins condensing. The solvent (114'), having condensed, diffuses into the oil, mixing with the oil and causing the oil's viscosity to be reduced. Additionally, the latent heat of vaporization (LHV), from the condensed solvent, assists in heating the formation (106) and further causing oil (e.g., bitumen), inside formation (106), to mobilize and melt. As used herein, the term "melting" (e.g., melting of oil), refers to the viscosity reduction of the oil (e.g., bitumen). In particular, the oil melts due to a combination of heat transfer from the condensing solvent, as well as the dissolution of the condensing solvent into the oil.

In some examples, the rate of dissolution of solvent into the oil is controlled by a rate of molecular diffusion of the solvent into the oil.

It will be appreciated that using a downhole electric heater (118*a*)—with a uniform temperature along its length-ensures that solvent (114) is in the vapor phase along the whole length of the injection well's horizontal section (102*a*). This, in turn, promotes uniform solvent entry into the formation (106), and the creation of a uniform solvent vapor chamber (122) above the injection well (102). Accordingly, this allows for effective recovery of oil (e.g., bitumen) from the entire reservoir volume.

Oil inside the formation (106) is also melted through conductive heat transfer from electric heater (118*a*), associated with the injection well (102). The driving force for the conduction heating is the temperature difference between the heater (118*a*) and the formation (106). In some examples, it is desirable to operate the injection well heater (118*a*) at the upper end of the preferred temperature range, which is discussed in detail further below. Operating the injection well heaters (118*a*) near the upper end of the preferred range is also desirable because the rate of diffusion of solvent (114') in oil, as described above, increases with increasing temperature.

In view of the foregoing, the viscosity of the oil is reduced—or otherwise, the oil can be melted—by the combination of one or more of: (i) condensation of the solvent and subsequent diffusion of solvent into the oil; (ii) convection heating resulting from condensation of solvent and release of the LHV of the condensing vaporized solvent (114'); and/or (iii) conductive heat transfer from the electric heater (118*a*). The conductive heating can also result from an electric heater (118*b*) associated with production tubing (118*b*), of production well (104), as explained herein.

Once melted, the liquefied oil (e.g. bitumen) consists of a mixture of the oil and condensed solvent (124). That is, the solvent vapor condenses as it transfers heat to the formation, and dissolves in the oil (e.g., bitumen), causing a reduction in the viscosity of the oil such that the oil becomes more mobile in the formation (106).

To that end, the melting of oil by the solvent is not a sequential process, but rather a continuous one in which solvent dissolves in oil, allowing its mobility to gradually increase thereby enabling the oil to move. The temperature effects and solvent dissolution combine to simultaneously reduce viscosity enough to increase oil mobility.

Similar to a SAGD process, mixture (124)—comprised of oil with reduced viscosity-drains downwardly through gravitational force. The mixture (124) is eventually received by the lower production well (104), via its horizontal well portion (104*a*).

It is important to note that in the case of SAGD, the viscosity reduction of oil is achieved purely by heating oil and raising its temperature via steam. A mixture of heated oil and steam condensate, at or near steam temperature, drains downwardly to the production well. Steam condensate, however, is insoluble in oil and does not mix with the oil. The 'mixture' in SAGD is therefore, in-fact, formed of two separate phases, oil and steam condensate. In contrast, in the disclosed process, solvent dissolves in oil such that there is primarily one phase in the mixture (124)—that is, mixture (124) is a true mixture of oil and dissolved solvent.

Continuing reference to FIG. 1A, as shown the horizontal portion (104*a*) of the production well (104) is located below that of the injection well (102). The mixture (124) may enter the production well (104) via one or more ports or slots (120*b*) lining the horizontal well portion (104*a*).

Inside production well (104), the liquid mixture (124) is conveyed or channeled through the well (e.g., via inner tubing (112*b*)), and upwardly through the vertical section (104*b*) to above ground (108).

In some examples, the conveyance of mixture (124), inside production well (104), is facilitated by a downhole pump (116*b*). Downhole pump (116*b*) can be a centrifugal pump, such as an electrical submersible pump. As provided, the downhole pump (116*b*) can also be used to control the bottom hole pressure, inside the production well (106).

As shown, mixture (124) is ultimately conveyed to a separation subsystem (150). Separation subsystem (150) can receive the mixture (124) via one or more above-surface conduits (140). In some examples, separation subsystem (150) is located above ground.

A well head control valve (142*b*) couples the above-ground conduit (140) to the inner tubing (112*b*), of production well (104). As explained, control valve (142*b*) can be used to control flow rate of produced fluid. In some examples, control valve (142*b*) is operated to maintain a desired bottom hole pressure. Control valve (142*b*) can also be used, for example, if the production well (104) begins to flow naturally as a result of solvent extricating out of mixture (124) and providing a "gas lift" effect.

More generally, separation subsystem (150) functions to receive mixture (124), and separate the oil (e.g., bitumen) from the solvent using any process and/or method known in the art (e.g., any solvent extraction process known in the art). In turn, separation subsystem (150) outputs and/or produces recovered oil (126) (e.g., recovered bitumen), and recycled liquid solvent (114).

The recovered oil (126) is generally mixed with diluent and typically carried downstream, for further processing, as needed. Meanwhile, the liquid solvent (114) can be recycled, and re-injected back into the formation (106) for further continued recovery of oil (126). For example, the recycled solvent is carried, via conduits (144), back to the injection tubing (112*a*).

In some cases, as the system (100*a*) is not able to recover all solvent injected into formation (106), system (100*a*) can also, over time, use a combination of solvent from separation subsystem (150), as well as solvent source (152). The solvent source (152) acts as a make-up source to account for the difference between solvent injected, and solvent recovered.

In view of the foregoing, the disclosed system (100*a*) has a number of appreciated advantages.

First, the system (100*a*) is more environmentally friendly than conventional SAGD processes. This is because system (100*a*) relies only on solvent (114) for oil and heavy oil recovery, rather than steam and water. The use of vaporized solvent (114') eliminates the need for energy intensive equipment, such as above surface water boilers which generate high pressure steam necessary for SAGD. System (100*a*) also avoids the requirement for large amounts of natural gas to heat water into steam. In turn, carbon emissions are minimized by use of system (100*a*).

To that end, less energy is required to vaporize the solvent than is the case to vaporize water (e.g., in SAGD). This is because the solvent has a lower latent heat of vaporization (LHV) than water, and the temperature is lower to vaporize the solvent than is the case for raising steam. Accordingly, considerably less energy is required, and therefore less fuel is burned, and carbon emissions are correspondingly lowered.

In some examples, the electricity used for operating the downhole electric heaters (118*a*) is generated in a 'green' fashion. Options for green electricity generation include, by way of non-limiting example, above ground hydroelectric power, wind, solar and nuclear sources. Accordingly, this can further minimize $CO_2$ emissions by system (100*a*).

Additionally, as system (100*a*) uses recycled solvent, it eliminates environmental problems with using large amounts of water, as required by SAGD. Second, system (100*a*) also addresses energy efficiency issues found in conventional SAGD processes. In a SAGD process, the water boilers do not operate at 100% efficiency. In addition, there are various heat losses in transporting steam, including heat losses from boilers to wellhead, and then from wellhead to reservoir, inside the well bore, as well as in all surface production systems. As well, in SAGD, large amounts of heat are withdrawn from the reservoir in the form of steam condensate, and not all the heat contained in steam condensate is recoverable. In contrast, in system (100*a*), there are minimal surface line or wellbore heat losses during injection because the heating is preformed downhole, in-situ, by the electric heater (118*a*).

Third, the upfront capital costs of system (100*a*) are substantially reduced as compared to SAGD. This is because need for a water source, steam generating equipment, and water treatment and recovery equipment is eliminated. Accordingly, small scale deployments of system (100*a*) are feasible. In particular, system (100*a*) can be used to develop smaller-sized deposits that would be otherwise difficult to develop economically with SAGD.

II. Operating Temperature Range for Downhole Electric Heater

The following is a discussion for an operating temperature range for electric heater (118*a*), which is associated with the injection tubing (112*a*) of injection well (102).

In at least some examples, electric heater (118*a*) is operated in a pre-defined temperature range that is, (i) above the vaporization temperature of the solvent (114); and (ii) below the saturated steam temperature for water, at reservoir conditions.

In this temperature range, the solvent (114) is heated to vaporize and rise into the formation (106). Importantly, however, this temperature range ensures that water located inside the formation (106) is not otherwise heated into steam vapor and thereby mobilized. This prevents (or at least minimizes) condensed water from moving with the oil and solvent mixture (124) in the reservoir.

There are a few appreciated advantages of ensuring that water is not heated into steam and does not otherwise move with mixture (124). First, water impedes the flow of the oil/solvent mixture (124) through the reservoir and into the production well (104). This is because, as known in the art, oil (e.g., bitumen) and water do not mix well because they are insoluble: they exist as separate phases, and flow separately.

More particularly, if water in formation (106) remains in the liquid state (i.e., not converted to steam), and is at its irreducible saturation—the liquid water is expected to remain, for the most part, locked in place by capillary pressure and is otherwise immobile. As such, liquid water flow in the formation (106) will not compete with the flow of oil or solvent vapor, and thus the relative permeability to oil, and oil mixed with solvent, will be higher. This, in turn, contributes to higher oil production rates.

To that end, a key concept of the disclosed design is to eliminate the movement of water so that the relative permeability of the oil/solvent mixture (124) is higher. This, in turn, raises the production rate of the oil/solvent mixture (124). In some examples, the temperature at which the injection well heater (118*a*) is operated is at the higher end of the prescribed pre-defined temperature range (as discussed above) to stimulate production, but below the saturated steam temperature to minimize movement of water.

Second, ensuring that the water does not move with mixture (124) also avoids, or substantially reduces, the requirement for expensive above-surface equipment to separate the water, from the oil and solvent mixture. In other words, it eliminates the need for oil-water surface separation equipment downstream of the production well (104), as is otherwise required in SAGD processes. In turn, the waste energy resulting from the production of hot steam condensate is eliminated, making system (100*b*) more energy efficient than SAGD.

Third, and more broadly, by operating the electric heater (118*a*) below the steam saturation temperature, the high energy requirement needed to vaporize water is eliminated.

In some examples, a solvent (114) is selected which, (i) can readily dissolve in heavy oil or bitumen, and (ii) has a vaporization temperature (e.g., boiling point) below the water steam saturation temperature at the reservoir pressure. This allows the downhole electric heater (118*a*) to be operated in the desired pre-defined temperature range, as noted above.

Here, it is understood that the saturated steam temperature necessarily varies based on reservoir pressure (i.e., pressure in formation (106) around wells (102), (104)). The reservoir pressure for a typical oil sand reservoir, is between 1800 and 2200 kPa, meaning that the saturated steam temperature is about 200° C. to 220° C. This sets the upper limit on the heater (118*a*) temperature to avoid boiling connate water in the reservoir.

In at least one example, the solvent (114) is selected as one or more of propane, dimethyl ether, butane or pentane. The latent heat of vaporization (LHV) of these solvents is much lower than that for water (steam), meaning that less energy is required to vaporize the solvent downhole compared to the energy needed to raise steam. For example, the critical temperature of propane is 96.67° C., dimethyl ether is 126.9° C., butane is 151.98° C. and pentane is 196.7° C. Heavier solvents (114), such as pentane, can be used in cases where the reservoir pressure is higher and therefore the saturated steam temperature is also higher allowing the use of a solvent with a higher boiling point. To that end, operating the electric heater (118*a*) at a temperature at or above the critical temperature of the solvent ensures that the solvent is in the vapor phase, regardless of the pressure.

In some examples, it is possible to use a solvent mixture comprised of two or more solvents. For example, a solvent mixture of propane and butane may be used.

In at lest one example, the solvent comprises one or more of a class of 'aliphatic hydrocarbons' or 'alkanes', having an LHV that is lower than water.

III. Bottom Hole Pressure Range

The bottom hole reservoir pressure (e.g., around wells (102), (104)) can be controllable to maintain the reservoir pressure at, and/or within, a pre-defined pressure range.

The bottom hole pressure can be adjusted and controlled in one of several manners. In at least one example, the pressure is controlled by the solvent injection rate. For example, by injecting a higher rate of liquid solvent (114), e.g., via injection tubing (112*a*), the reservoir pressure is increased. The solvent injection rate can be adjusted and controlled by controlling any one of the solvent pumps (116*a*) and/or well head control valve (142*a*) (FIG. 1A).

In another example, the bottom hole pressure is maintained by controlling back pressure exerted by the production tubing (112*b*). For example, this is effected by controlling the down hole production pump (116*b*) and/or the surface well head control valve (142*b*) (FIG. 1A).

In some examples, one or more pressure sensors (132) (FIG. 1A) are included in system (100*a*). For example, one or more pressure sensors (e.g., pressure gauges) are located in, or around, the injection tubing (112*a*) and/or production tubing (112*b*). As explained below, these sensors can be used to monitor the bottom hole pressure.

In many cases, it is desirable for control system (100*a*) to ensure that the bottom hole pressure is maintained at constant initial reservoir pressure conditions (e.g., conditions prior to operating system (100*a*) and recovering oil). The reasons for this include the following:

First, it minimizes the risk of unwanted fluid (e.g., water) from entering the production well (104*b*) from the surrounding formation (106). For example, if the reservoir includes mobile water nearby—operating at below reservoir pressure increases the risk of water entering the production well (104) from, e.g., a bottom water aquifer.

Second, maintaining the pressure relatively close to the original reservoir condition also allows the process to be used where there is weak or nonexistent cap rock. This is not possible with steam injection, using SAGD, as steam injection rates are very high as are the injection pressures.

Third, exceeding initial reservoir conditions increases the risk of loss of injected solvent (114) to the reservoir. Some reservoirs may have 'thief zones' into which the injected solvent leaks, and does not contribute to bitumen recovery. This negatively impacts overall economics as solvent (114) is generally expensive. It is therefore important to keep the recovery of injected solvent as high as possible to minimize the need for make-up solvent (e.g., from solvent source (152)), thereby reducing operating costs.

Fourth, if the heater in the injection well (112*a*) is operated at a temperature at the upper end of the desirable temperature range (e.g., just below the saturated steam temperature at original reservoir pressure), the part of the reservoir near the production well (112*b*)—e.g., being only approximately 5 meters from the injection well-will, in time, reach this temperature. Accordingly, if the pressure in the production well (112*b*) is allowed to drop below the original reservoir pressure, it may decrease to a pressure at which the formation water can flash into steam. This would be undesirable except in the case where the formation water is deliberately removed from the near-well region by running the heaters at temperatures above the saturated steam temperature at reservoir pressure in order to remove the water during the start-up phase. As such, to prevent water production caused by the flashing of formation water, it is preferable to maintain reservoir pressure above that corresponding to the saturated steam pressure at the temperature at which the injection well heater is operated.

IV. Production Tubing

As the mixture (124) is conveyed through the production tubing (112*b*), it may be necessary to ensure that the mixture (124) does not cool-off. By ensuring that the mixture (124) stays warm, the oil in the mixture remains warm enough and therefore mobile enough (e.g., low viscosity) to be transported through the vertical section of the production well (104) to surface and subsequently through above-surface conduit piping (140) (FIG. 1A).

In at least one example, the production well's inner tubing (112*b*) can include one or more associated electric heaters (118*b*). The electric heaters (118*b*) can be positioned, for example, along the vertical well portion (104*a*), and operated to keep the mixture (124) warm.

In some examples, the electric heaters (118*b*) are controlled independently from the electric heaters (118*a*) in the injection well (102). For example, electric heaters (118*b*) can be operated at a lower temperature (e.g., 90° C.), so as to minimize power draw and release of solvent from the oil/solvent mixture.

The electric heaters (118*b*) can also be resistive electric heaters. Further, the electric heaters (118*b*) can be connected to one or more power sources (e.g., green power sources). Although only one electric heater is exemplified, there may in-fact be more than one electric heater (118*b*) associated with the production tubing (112*b*).

Similar to the electric heaters (118*a*) inside the injection well (102), the electric heaters (118*b*) can be located within the production tubing (112*b*) of the production well (104). In other examples, the electric heaters (118*b*) can be located at any other position within or surrounding the production tubing (112*b*).

In some examples, the electric heater (118*b*) can extend for a portion of the length of the production well (104), such that it can be referred to as an elongate electric heater (or otherwise, an elongate resistive electric heater).

In at least one example, electric heater (118*b*) can extend along an axis coaxial with an axis of extension of the production well (104), or at least, the well's inner tubing (112*b*) (e.g., along the horizontal well portion). In some examples, the elongate electric heater (118*a*) extends for a length that is equal, or substantially equal, to the segment of the inner tubing (112*b*) that includes slots (120*b*).

It is also possible that the elongate heater (118*a*) is segmented into two or more heaters (118*b*) positioned consecutively.

In other examples, the mixture (124) is maintained at a warm temperature by using an insulated inner tubing within the production well (104). For instance, as shown, the insulated inner tubing (128) is installed along the vertical well portion (104*b*), of production well (104).

The insulated tubing (128) forms an extended portion of the inner tubing (112*b*). The insulated tubing prevents the mixture (124) from cooling-off, owing to heat losses as the mixture (124) is conveyed upwardly. In particular, as pressure is reduced, solvent is released from mixture (124) into the vapor phase. In turn, this causes the remaining oil in mixture (124) to increase in viscosity and become less mobile within the production well (104). Accordingly, the insulated tubing (128) maintains the warm temperature of liquid in the vertical section of the production well to maintain its mobility.

In some examples, the insulated tubing (128) is not necessarily continuous. For example, inner tubing (112*b*) may have one or more disjointed and/or connected portions of insulated tubing (128).

In still other examples, a heating source (134) is wrapped around, or within, the inner tubing (112), e.g., along the vertical well section (104*b*). For example, this can include electrical heating tape. The heating source (134) can be used as a source of additional heat, to maintain the mixture (124) at a warm temperature.

In some examples, heating source (134) may be used if there is a shutdown period for system (100*a*) or for production well (104). During such shutdown oil viscosity may increase to the point where the oil is no longer mobile due to cooling, and also due to loss of solvent from the oil/solvent mixture as a result of reduced pressure.

V. Horizontal and Vertical Wells

Figure 1B:
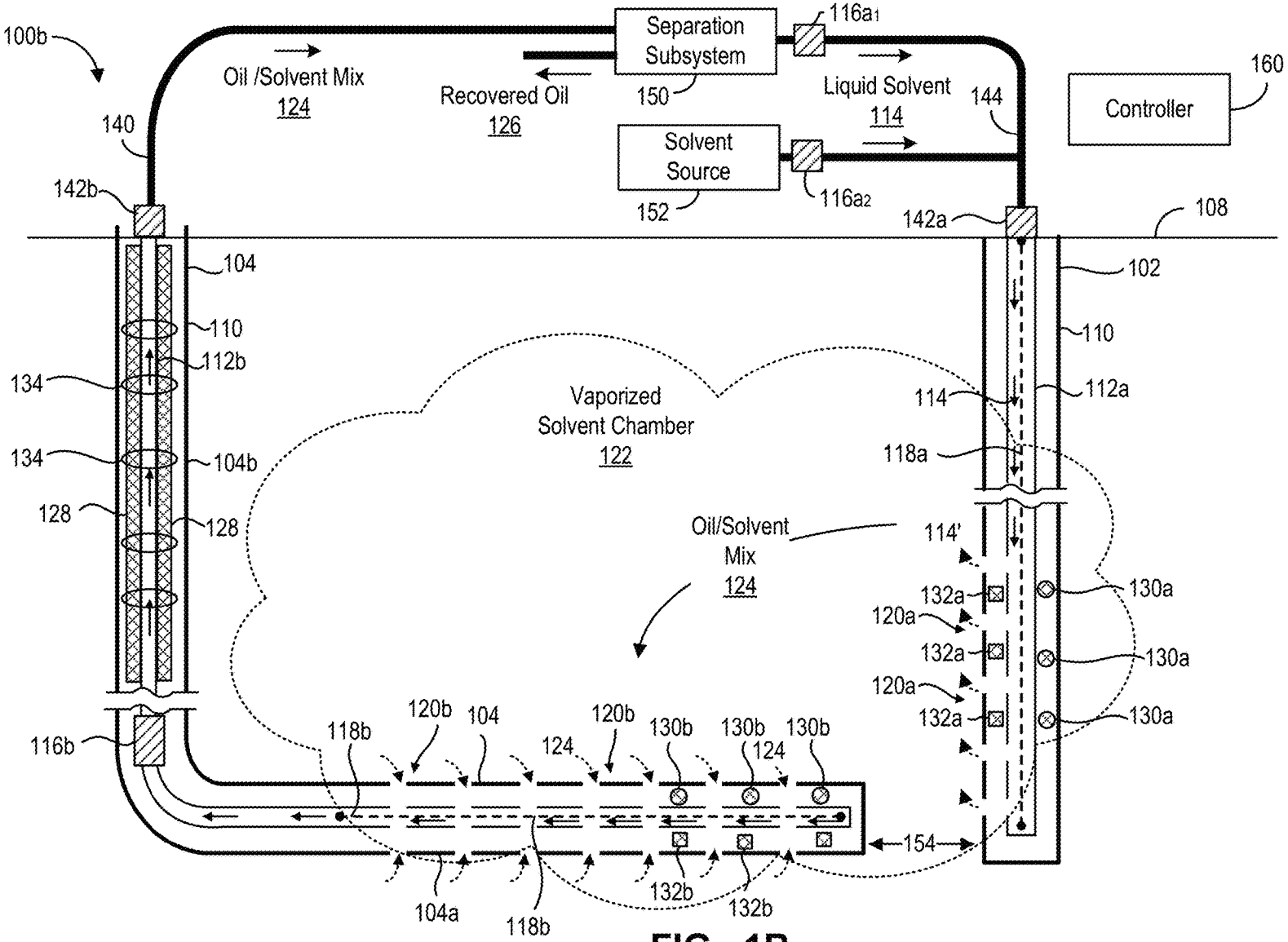
FIG. 1B is another example system for oil production and recovery using solvent-assisted electric heating.

Reference is now made to FIG. 1B, which shows another example system (100*b*) for oil production and recovery using solvent-assisted electric heating.

System (100*b*) is generally analogous to system (100*a*), with the exception that system (100*b*) includes a combination of horizontal and vertical wells. In this example, the injection well (102) has a generally vertical configuration, rather than a horizontal configuration as shown in system (100*a*). In some cases, the vertical injection well (102) is laterally spaced from a distal end, of the horizontal production well (104), by a distance (154) that is five or more meters (e.g., ten meters).

At least one advantage of the exemplified configuration is that the vertical injection well (102) has a lower cost compared to using a horizontal injection well. Further, as compared to a single horizontal well configuration (see FIG. 1C, discussed below), system (100*b*) has generally improved process control.

VI. Single Well

Figure 1C:
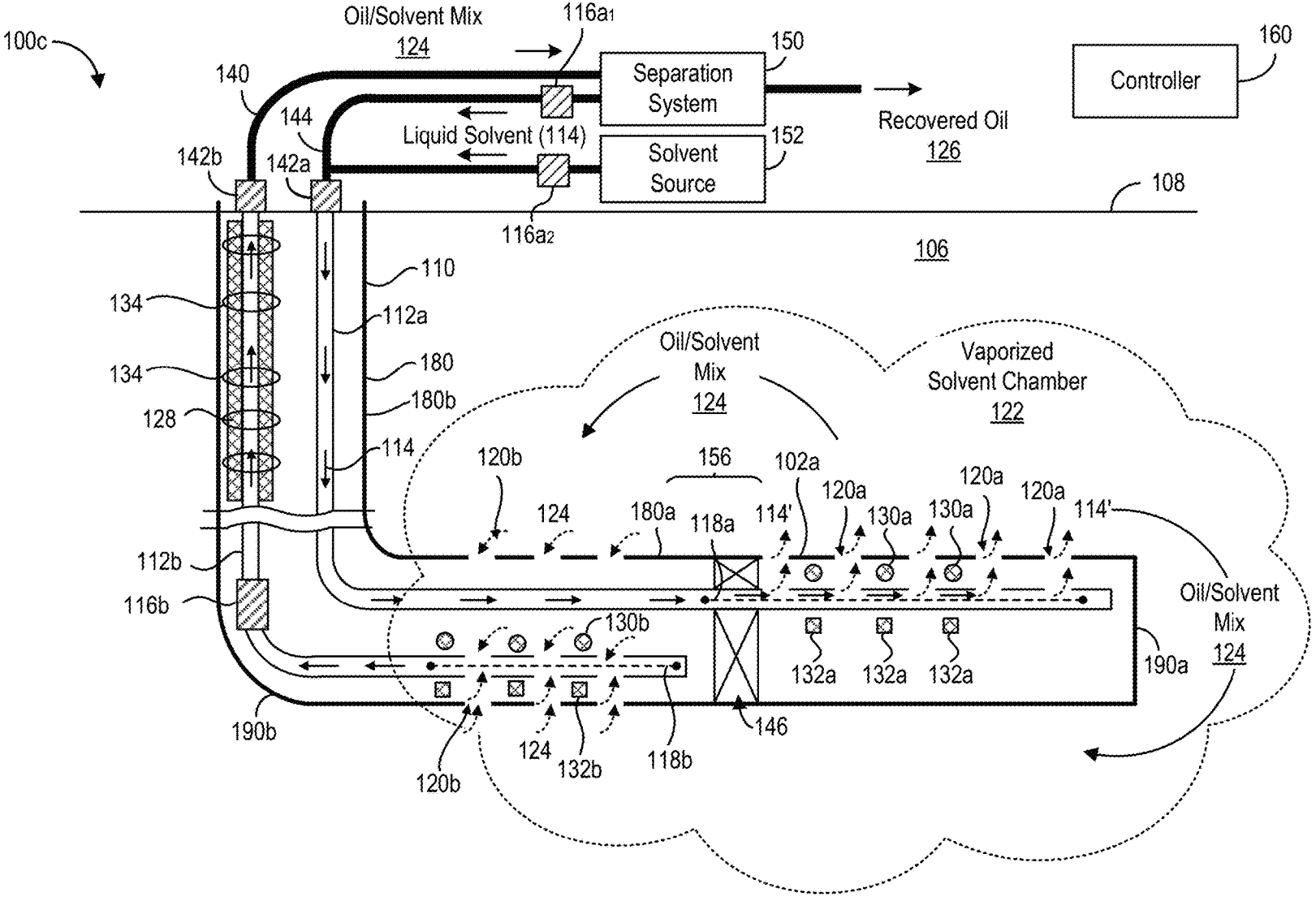
FIG. 1C is still another example system for oil production and recovery using solvent-assisted electric heating.

Reference is made to FIG. 1C, which shows another example system (100*c*) for oil production and recovery using solvent-assisted electric heating.

System (100*c*) is also generally analogous to system (100*a*), with the exception that only a single well (180) is provided. Well (180) provides an outer casing (110) for both an inner injection tubing (112*a*), and an inner production tubing (112*b*). The two tubes can run in parallel, or side-by-side, as exemplified.

More generally, the well (180), itself, can include a horizontal well portion (180*a*) and a vertical well portion (180*b*).

As shown, along the horizontal well portion (180*a*), a distal end (190*a*)—e.g., distal from the vertical portion (180*b*)—can include slots or ports (120*a*) for injecting the vaporized solvent (114') from injection tubing (112*a*). Further, a proximal end (190*b*) can include slots or ports (120*b*) for receiving the mixture (124) into the production tubing (120*b*).

In some embodiments, the vertical sections of the two tubing strings (112*a*), (112*b*) are in close contact such that warm produced fluid preheats the injected solvent (114), thereby reducing the power required by the injection well heater (118*a*) to vaporize the solvent downhole. This can make the process more energy efficient and reduce operating cost, thus improving operational economics of system (100*c*).

As exemplified, casing (110) can include a blank casing section (156) that does not include slots or ports (120). Accordingly, there is no flow into or out of the formation along the blank casing section (156) of the well.

More generally, the blank casing section (156) can be important for enabling the recovery process using a single well configuration. In particular, a pressure drop is caused across the blank casing section (156) by the flow of fluids through the reservoir from the injection end (distal) of the well to the production end (proximal) of the well. The pressure drop is important for control of the process, and without it, injected solvent may simply flow directly from the injection ports (120*a*) to the production ports (120*b*), with little contact with the reservoir.

Figure 3A:
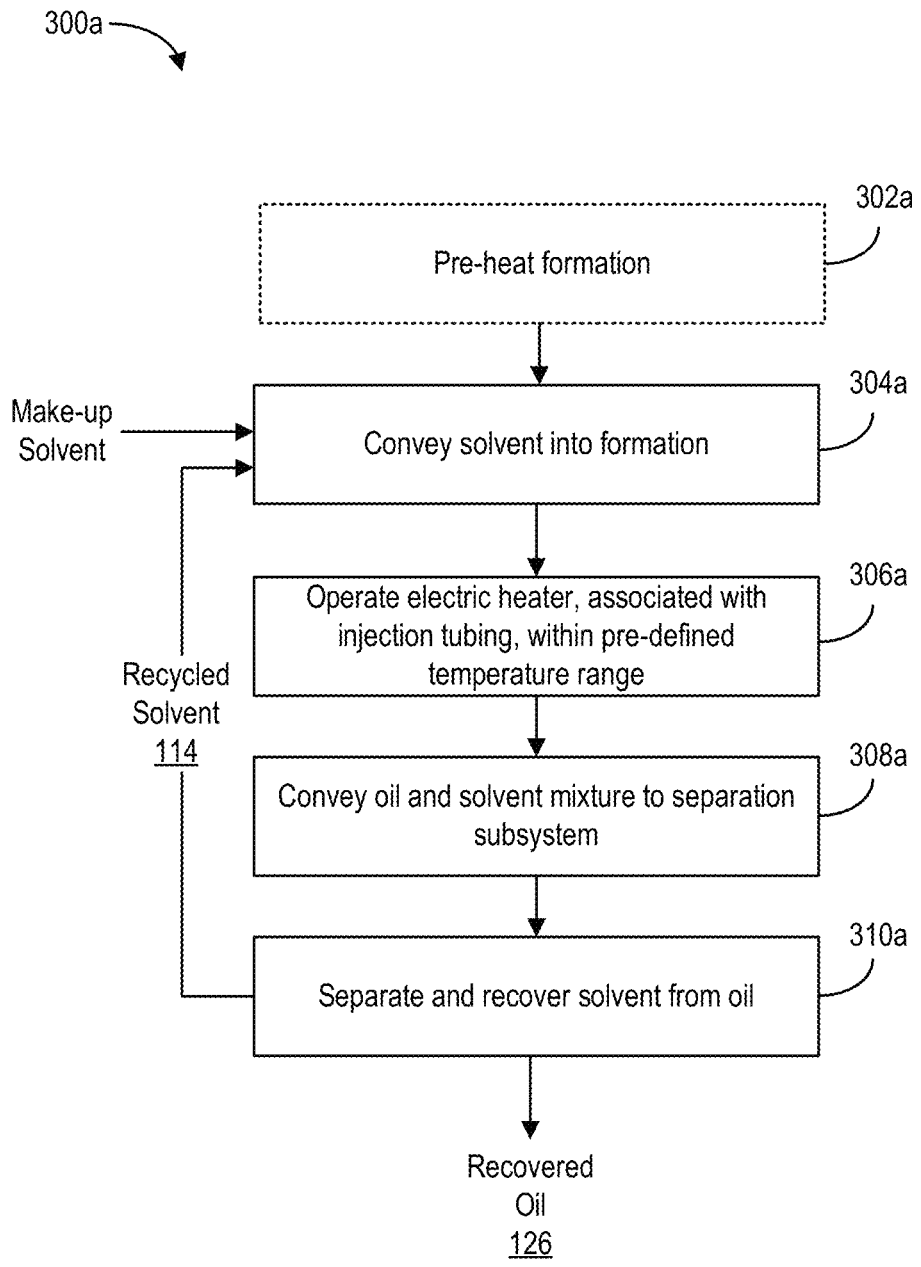
FIG. 3A is a process flow for an example method for oil production and recovery using solvent-assisted electric heating.
Figure 3B:
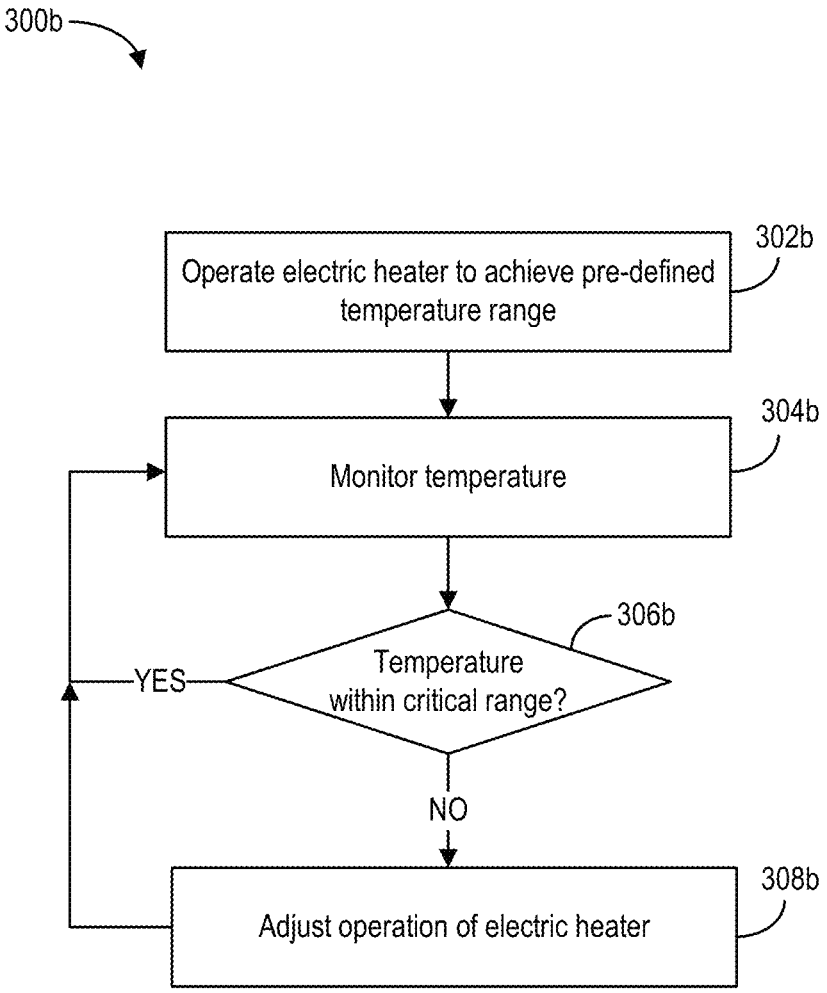
FIG. 3B is a process flow for an example method for temperature control of one or more electric heaters.
Figure 3C:
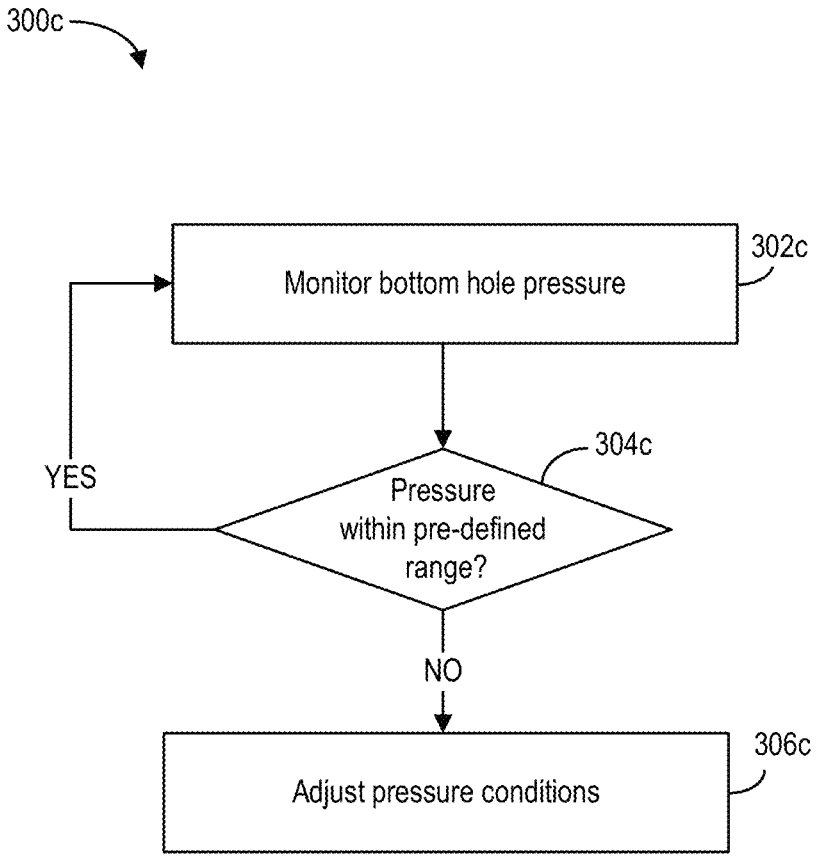
FIG. 3C is a process flow for an example method for bottom hole pressure monitoring and control.
Figure 3D:
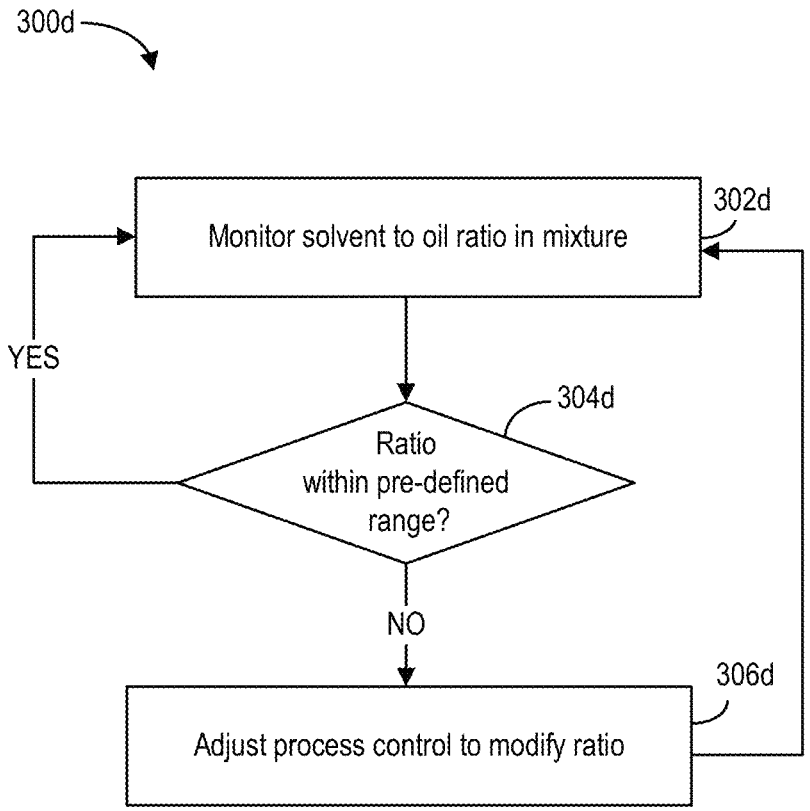
FIG. 3D is a process flow for controlling operation of a system for solvent-assisted electric heating.

In some examples, control of the process flow in system (100*c*) is effected by accurate monitoring of the injection and production side bottom hole pressures (as explained with reference to FIG. 3C), as well as by sampling on surface to ensure that the produced fluid stream mixture (124) contains oil and solvent in the desired ratio (FIG. 3D).

As exemplified, the blank casing section (156) can also accommodate and provide support for a downhole packer (146), as known in the art.

At least one appreciated advantage of the exemplified single well design is that it can be used to extract oil from geologically thinner formations. As well, compared to double well configurations, the single well design offers cost savings and improved economics such that poorer quality reservoirs may be considered for development.

VII. System Electrical Hardware Architecture

Figure 2:
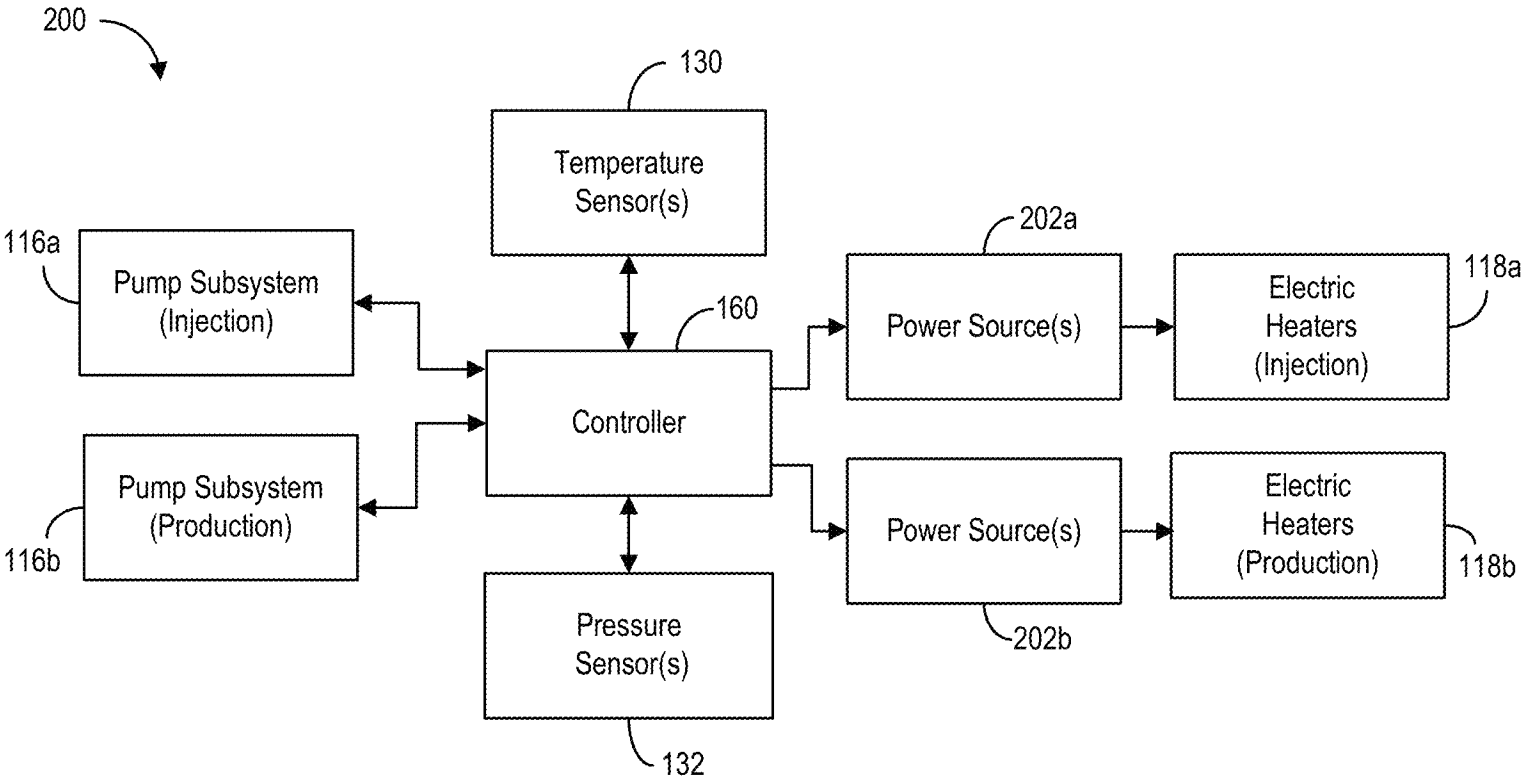
FIG. 2 is a simplified example system-wide electrical hardware block diagram.

Reference is now made to FIG. 2, which shows an example electrical hardware architecture (200) for system (100*a*) and/or system (100*b*) and/or system (100*c*).

As shown, system (100*a*) can include a controller (160) which is connected (e.g., via wires or wirelessly) to one or more system components.

Generally, controller (160) can adjust various operating parameters for the systems (100*a*), (100*b*), (100*c*) including the power settings, the heater temperature settings, fluid injection rates and production well constraints. While there are general guidelines governing these operating parameters, they can be refined for each specific reservoir case and can depend on the properties of the oil, the reservoir conditions, and the type of solvent selected.

As further shown, controller (160) can couple to one or more of the temperature sensors (130), pressure sensors (132), pump subsystems (116*a*) and (116*b*) of FIG. 1A. Controller (160) can also couple to power sources (202*a*) and (202*b*), which deliver power to electric heaters (118*a*), (118*b*). While not explicitly illustrated, controller (160) can also couple to one or more well head control valves (142*a*) and (142*b*), as well as to a power source for heating (134) (FIG. 1A).

In more detail, as shown in FIG. 1A, temperature sensors (130*a*) monitor the temperature in an area where solvent is injected into formation (106). For example, the temperature sensors (130*a*) can monitor the area around the horizontal portion (102*a*) of the injection well (102).

More generally, the temperature sensors (130*a*)—associated with injection well (102)—monitor the temperature around electric heater (118*a*) to determine if the heater is operating within the correct temperature range, e.g., (i) above the critical temperature for vaporizing the solvent, but (ii) below the steam saturation temperature at reservoir pressure.

Temperature data, acquired by temperature sensors (130*a*), can be transmitted to controller (160). In turn, controller (160) uses the temperature data to modify (e.g., adjust) operation of the electric heater (118*a*).

In some examples, controller (160) is also coupled to one or more temperature sensors (130*b*), associated with the production well (104) (FIG. 1A). These temperature sensors (130*b*) monitor the temperature in an area where oil and solvent mixture (124) is received into production well (104). For example, the temperature sensors (130*b*) can monitor the area around the horizontal portion (104*a*) of production well (104). In particular, this allows the system to determine whether the electric heater (118*b*) is operating at a sufficient temperature to prevent cooling of mixture (124), as explained previously.

To that end, any type of temperature sensors (130) can be used in system (100*a*). In at least one example, the temperature sensors (130) comprise fiber optic cables that extend from above surface (108).

In some cases, multiple temperature sensors (130) are provided in respect of each of the injection well (102) and/or production well (104). In these cases, the controller (160) can receive multiple temperature readings, and can combine the readings in any manner (e.g., via averaging).

Figure 1D:
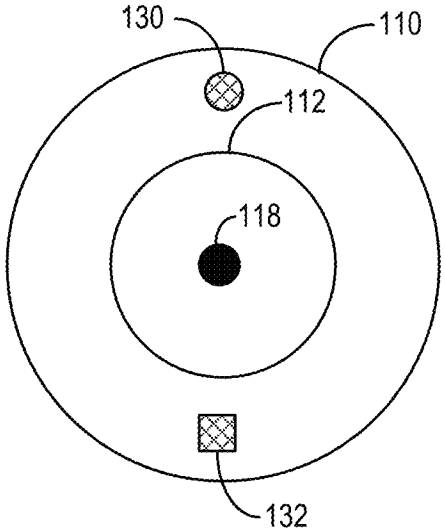
FIG. 1D is a cross section of an injection well, used in the system of FIG. 1A, taken along the section line 1D-1D' in FIG. 1A.

Temperature sensors (130) can also be positioned in any manner relative to the tubes (112*a*), (112*b*). For example, as shown in FIGS. 1A and 1D, the temperature sensors (130) can be disposed in any area between the inner tubing (112) and outer casing (110), of each well (102), (104).

In some examples, temperature sensors (130)—such as Fibre optic cables—may be strapped to the outside of the tubing strings (112*a*), (112*b*), or be combined with the electric heaters (118*a*), (118*b*) and placed with the heaters inside the tubing strings (112*a*), (112*b*).

Pressure sensors (132*a*), also shown in FIG. 1A, can also be positioned around the horizontal portion (102*a*), of injection well (102). As explained previously, the pressure sensors (132*a*) are used to monitor bottom hole pressure.

In some examples, pressure sensors (132*a*) transmit pressure data to the controller (160). Controller (160) can use the pressure data to determine whether the bottom hole pressure is maintained within a pre-defined pressure range (e.g., sufficiently close to initial reservoir pressure). If not, the controller (160) can control operation of one or more of the pump subsystems (116*a*), (116*b*) and/or well head control valves (142*a*), (142*b*), as previously described.

Pressure sensors (132*b*) can also be positioned around the horizontal portion (104*a*) or production well (104).

Controller (160) is also coupled to one or more power sources (202*a*), (202*b*). Power sources (202*a*), (202*b*) provide independent power to each of the electric heaters (118*a*), (118*b*) associated with each of the injection tubing (112*a*) and production tubing (112*b*), respectively. Controller (160) can adjust operation of the power sources (202*a*), (202*b*) to deliver more or less input power to electric heaters (118*a*), (118*b*).

Any suitable power sources (202*a*), (202*b*) can be provided. In at least one example, the power sources (202) comprise batteries. In other examples, the power sources can be green energy sources, such as hydroelectric power, wind, solar and nuclear sources.

In still other cases, electric power may result from co-generation of steam and electricity. This may be particularly useful in existing SAGD operations where steam is used for oil recovery, and electricity is sold into the grid. The electricity, however, could be used instead for additional, low cost oil production without the need for substantial facilities modifications involving additional plant capital cost.

In other examples, a single power source (202) is provided in conjunction with both electric heaters (118) and/or heating source (134) (FIG. 1A).

While only a single controller (160) is illustrated, it is possible that the system includes multiple controllers. Each controller can control independent and/or overlapping aspects of the system.

VIII. Example Processes

Various example processes are now described, in accordance with the disclosed embodiments.

(i) General Process.

Reference is made to FIG. 3A, which shows a process flow for an example method (300*a*) for oil production and recovery using solvent-assisted electric heating.

In some examples, method (300*a*) is performed manually. In other examples, method (300*a*) is fully or partially automated, by controller (160). That is, method (300*a*) can be executed by a processor of controller (160).

As shown, at (302*a*), the formation (106) can be pre-heated. For example, as part of a start-up phase for oil recovery, formation (106) is pre-heated by operating one or more electric heaters (118*a*), (118*b*), associated with injection tubing (112*a*) and production tubing (112*b*).

More generally, the pre-heating results in conductive transfer of heat from the electric heaters (118) into formation (106). This assists in melting, and initially mobilizing, solidified oil in formation (106). Accordingly, at least in system (100*a*), a degree of fluid communication is established in the inter-well region, and as between the injection and production wells (102), (104) (e.g., FIG. 1A).

To prevent mobilizing water inside the formation (106), during the pre-heating stage, the electric heaters (118) can be operated at a temperature range below the saturated steam temperature of water, based on the initial reservoir conditions.

In some examples, the electric heaters (118) at act (302*a*) are operated such that the temperature at the midpoint between the two wells (e.g., 2.5 meters approximately, if the wells are 5 meters apart) reaches about 90° C. to have the oil (e.g., bitumen) viscosity reduced sufficiently to enable flow. Heating to a level of 90° C. is below the saturated steam temperature at reservoir conditions (e.g., normally in the range of 180° C. to 220° C.), and the water present in the formation (normally referred to as connate water, typically with saturation of 15% to 25% of the pore space), which is usually immobile, will not mobilize and will continue to be present for the duration of the recovery process Additionally, or in the alternative, the pre-heating stage (302*a*) can also involve operating the electric heaters (118) to remove connate water from a near wellbore region.

In at least one example, removal of connate water from the near well vicinity is performed by running the heaters (118) in both wells at temperatures above the saturated steam temperature during the preheating stage. In some cases, the electric heaters (118) are not operated at temperatures above approximately 240° C., as thermal cracking of bitumen can occur thereby causing the deposition of solid 'coke' which can plug the formation, and result in release of hydrogen sulfide (i.e., a by-product of the thermal cracking).

In examples where electric heaters (118) are operated to remove connate water, the production well (104) may need to be open to flow to allow mobilized water and oil to be removed from the near well vicinity and produced to surface. In some cases, the wells are filled with solvent to help push mobile fluids out of the near well area.

In some cases, it may be advantages to also produce fluids from the injection well during the start-up period. This could take advantage of the natural tendency of the solvent vapor to rise in the formation. In this case the production well heater (118*b*) could be operated at a higher temperature than the injection well heater (118*a*), during the pre-heating stage.

In these examples, the injection well heater (118*a*) can also be operated at a higher temperature, with the upper well open to production to take advantage of the water vapor rising in the formation (e.g., to potentially speed up the process). Different solvents can also be used in the two wells with, for example, a less volatile solvent being used in the upper well during startup, or possibly no solvent in the upper well to encourage flow into the well.

To that end, removal of the connate water from the near wellbore region, during the preheating stage (302*a*), can increase the available pore space for flow of the oil/solvent mixture (124) into the production well during the majority of the recovery process and therefore enhance the production rate. More particularly, with the water removed, the effective permeability to the oil/solvent mixture (124) will be close to the absolute permeability of the formation near the wells, which has a stimulating effect on production.

At (304*a*), the system is operated to convey liquid solvent (114) into formation (106). For example, one or more of the solvent pumps (116*a*1), (116*a*2) are operated to pump liquid solvent (114) into the injection tubing (112*a*). In some examples, the injection well head control valve (142*a*) is also operated to control injection of solvent (114).

Initially, when the system is first operated—the solvent (114) is only pumped from the solvent source (152). Subsequently, solvent (114) is then pumped from one or more of the solvent source (152) and separation subsystem (150).

The pumped liquid solvent (114) is then conveyed through the injection tube (112*a*), and is carried below ground (FIG. 1A).

At (306*a*), as the solvent (114) is conveyed, the electric heater (118*a*)—associated with the injection tubing (112*a*)—is operated at a pre-defined temperature range. As explained, this temperature range is characterized as being: (i) above the vaporization temperature of the selected liquid solvent (114), and (ii) below the saturated steam temperature of water at reservoir conditions.

In this temperature range, the electric heaters (118*a*) cause in-situ vaporization of the liquid solvent (114). In turn, the solvent (114) vaporizes and exits the injection tubing (112*a*) and rises into formation (106). The electric heaters (118*a*) do not, however, cause mobilization of water present inside the formation (106).

In some examples, act (306*a*) is preformed concurrently with act (304*a*), or otherwise before act (304*a*). In some cases, once pre-heating is complete, the electric heater (118*a*) is adjusted to operate within the pre-defined temperature range, prior to injecting solvent (114).

At (308*a*), as the solvent dissolves into the oil in formation (106), it mobilizes the oil (e.g., bitumen) and produces an oil and solvent mixture (124). The oil and solvent mixture (124) is received through the production tubing (112*b*), and conveyed to the separation subsystem (150).

In some cases, the downhole production well pump (116*b*) and/or production well head control valve (142*b*) are operated to facilitate conveyance of the mixture (124) to the separation subsystem (150).

To ensure that the mixture (124) is sufficiently warm during its conveyance above ground-electric heater (118*b*), associated with the production tubing (112*b*), can also be operated. In some examples, this heater is operated independently from electric heater (118*a*). For example, it can be operated at a lower temperature than heater (118*a*) (e.g., 90° C.). Heating sources (134) (FIG. 1A) can also be operated to ensure that the mixture (124) remains sufficiently warm.

At (310*a*), the mixture (124) is received at the separation subsystem (150) (FIG. 1A). Separation subsystem (150) functions to separate the oil from the solvent.

The recovered oil (126) is conveyed downstream for further processing. The recovered solvent (114) can be recycled and used for further oil production and recovery. In this case, the solvent (114) is conveyed back into the formation, e.g., via the injection tubing (112*a*).

As not 100% of the solvent conveyed into the formation (106), will be necessarily recovered—in subsequent iterations of process (300*a*), at (304*a*), the recycled solvent can be combined with make-up solvent, e.g., from solvent source (152).

(ii) Method of Controlling Temperature of Electric Heaters.

Reference is now made to FIG. 3B, which shows an example method (300*b*) for controlling the electric heaters (118*a*) associated with the injection tubing (112*a*).

In some examples, method (300*b*) is performed manually. In other examples, method (300*b*) is fully or partially automated, by controller (160). That is, method (300*b*) can be executed by a processor of controller (160).

At (302*b*), the electric heater (118*a*) is operated within the pre-defined temperature range. As noted above, this range is characterized as being (i) above vaporization temperature of the selected solvent (114), and (ii) below the saturated steam temperature of water, at reservoir conditions.

At (304*b*), the temperature around and/or inside the injection tubing (112*a*) is monitored. For example, as shown in FIG. 1A, one or more temperature sensors (130*a*)—associated with the injection tubing (112*a*)—can monitor the surrounding temperature. The temperature sensors (130*a*) may generate temperature data, which is transmitted above ground, e.g., to controller (160).

At (306*b*), it is determined whether the temperature is within the pre-defined temperature range. If more than one temperature sensor (310*a*) is provided, the temperature data can be combined any manner. For example, the temperature data can be averaged to generate an average temperature reading. It is then determined whether the average temperature is within the pre-defined temperature range.

If the temperature is within the pre-defined temperature range, the method can return to act (304*b*) to continue monitoring the temperature.

Otherwise, at act (308*b*), the operation of the electric heater (118*a*) is adjusted or modified (e.g., increased or decreased), to achieve the desired pre-defined temperature range. For example, the power source (202*a*)—coupled to electric heater (118*a*)—is controlled to vary the level of input power delivered to electric heater (118*a*).

In some examples, method (300*b*) is preformed manually. For example, an operator receives temperature data at (304*b*), and manually adjust the operation of the electric heater (308*b*), e.g., via power source (202*a*).

In other examples, method (300*b*) is preformed automatically. In other words, controller (160) receives the temperature data (304*b*), and automatically determines whether the temperature is in the pre-defined temperature range (306*b*). In turn, controller (160) can automatically adjust operation of the electric heater (118*a*).

In still other examples, method (300*b*) is performed partially automatically, e.g., some acts may be performed manually, while other performed automatically.

While not shown, a similar method to method (300*a*) can be used to control the electric heaters (118*b*) associated with the production tubing (112*b*), e.g., to achieve a desired temperature range. In this case, the temperature around or inside the production tubing (112*b*) can be monitored using one or more temperature sensors (130*b*) associated within the production tubing (112*b*).

(iii) Method for Controlling Pressure.

Reference is now made to FIG. 3C, which shows an example method (300*c*) for controlling bottom hole pressure.

In some examples, method (300*c*) is performed manually. In other examples, method (300*c*) is fully or partially automated, by controller (160). That is, method (300*c*) can be executed by a processor of controller (160).

At (302*c*), the bottom hole pressure surrounding the wells (102), (104) is monitored. In the example of system (110*b*), the bottom hole pressure surrounding well (180) is monitored.

As shown in FIGS. 1A to 1C, one or more pressure sensors (132*a*), (132*b*) may be provided in the injection well (102) and production well (104) (FIG. 1A), or otherwise the single well (180). Various pressure sensors known in the art can be used.

In some examples, pressure data from one or more pressure sensors (132) may be transmitted to controller (160). Controller (160) may automatically monitor and determine the bottom hole pressure from the pressure data. In some examples, the controller (160) averages the pressure data, from the one or more pressure sensors (132), to resolve the bottom hole pressure. In other examples, a human operator can monitor and determine the bottom hole pressure based on the received pressure data.

At (304*c*), it is determined whether the measured bottom hole pressure is at a pre-defined or desired bottom hole pressure. In at least some examples, the desired bottom hole pressure corresponds to the initial reservoir pressure. As explained above, there are various appreciated advantages of maintaining the bottom hole pressure at the original reservoir pressure conditions.

If the measured pressure is at the pre-defined reservoir pressure, then the method (300*c*) can return to act (302*c*) to continue monitoring.

Otherwise, if the measured pressure is not at the pre-defined reservoir pressure, then at (306*c*), the bottom hole pressure conditions are adjusted to compensate for the difference. This may involve either increasing or decreasing the pressure, to achieve the desired pressure conditions.

To that end, there are various techniques that can be used to adjust the bottom hole pressure condition. In at least one example, the bottom hole pressure is varied by controlling the production well pump (116*b*) (e.g., FIG. 1A). For example, pump (116*b*) can be controlled to pump out a greater volume of mixture (124), so as to decrease bottom hole pressure. Otherwise, pump (116*b*) can be controlled to pump out less volume of mixture (124), to increase bottom hole pressure. In this example, the solvent injection rate into the injection tube (112*a*) may be kept constant throughout.

The production well head control valve (142*b*) can also be adjusted to accomplish a similar function to the production well pump (116*b*).

In another example, the bottom hole pressure is varied by controlling the solvent injection rate, into the injection tubing (112*a*). For example, the solvent injection rate is controlled by the solvent pumps (116*a*) (e.g., FIG. 1A). Injecting a greater rate of solvent (114) increases bottom hole pressure, while injecting a lower rate of solvent (114) decreases bottom hole pressure. In these examples, the production well pump (116*b*) is maintained at a constant operation (e.g., pump speed), throughout.

At least one appreciated advantage of controlling bottom hole pressure via the production well pump (106*b*) (i.e., rather than solvent pumps (106*a*)) is that it can stabilize the power delivered to the injection well electric heaters (118*a*), and therefore, simplify power delivery/process operation.

In still another example, the bottom hole pressure is varied by controlling a combination of both the solvent pump (116*a*) and/or production well pump (116*b*).

The control of the pumps (116*a*) and/or (116*b*) can be effected automatically by controller (160), and/or manually by human operation.

(iv) Method for Monitoring Solvent to Oil Ratio.

In some examples, the solvent to oil ratio in mixture (124) is sampled and monitored, and used to control operation of the system. If the solvent to oil ratio is too high, this can indicate that the oil recovery process is not operating effectively, as too much solvent is injected and produced with insufficient yield of oil.

FIG. 3D shows a method (300*d*) for controlling operation of a system for solvent-assisted electric heating.

In some examples, method (300*d*) is performed manually. In other examples, method (300*d*) is fully or partially automated, by controller (160). That is, method (300*c*) can be executed by a processor of controller (160).

As shown, at (302*d*), the solvent to oil ratio in mixture (124) is monitored. In some examples, the mixture is monitored by a monitoring assembly associated with (e.g., integral with, or otherwise directly/indirectly coupled to) the separation subsystem (150). The monitoring can be performed by sampling the incoming mixture (124), and applying any known method in the art to determine the ratio of solvent to oil in the sampled mixture. The monitoring can be performed continuously, or at any pre-defined or selected time or frequency interval.

At (304*d*), it is determined whether the ratio is within a pre-defined range (or below a pre-defined threshold). For example, this can involve ensuring that the ratio is below approximately 1.0.

If the ratio is at the desired level, the system can resume monitoring at (302*d*). Otherwise, at (306*d*), operation of the system is adjusted to modify the ratio to within the desired levels. For example, this can involve increasing the back pressure on the production well (e.g., via valve (142*b*) and/or pump (116*b*)) to force more solvent into the formation. In other cases, the process can be slowed down by reducing the solvent injection rate (e.g., via controlling valve (142*a*) and/or pumps (116)), allowing more time for the solvent to dissolve into the oil, thereby increasing oil production.

IX. Example Hardware Configuration for Controller

Figure 4:
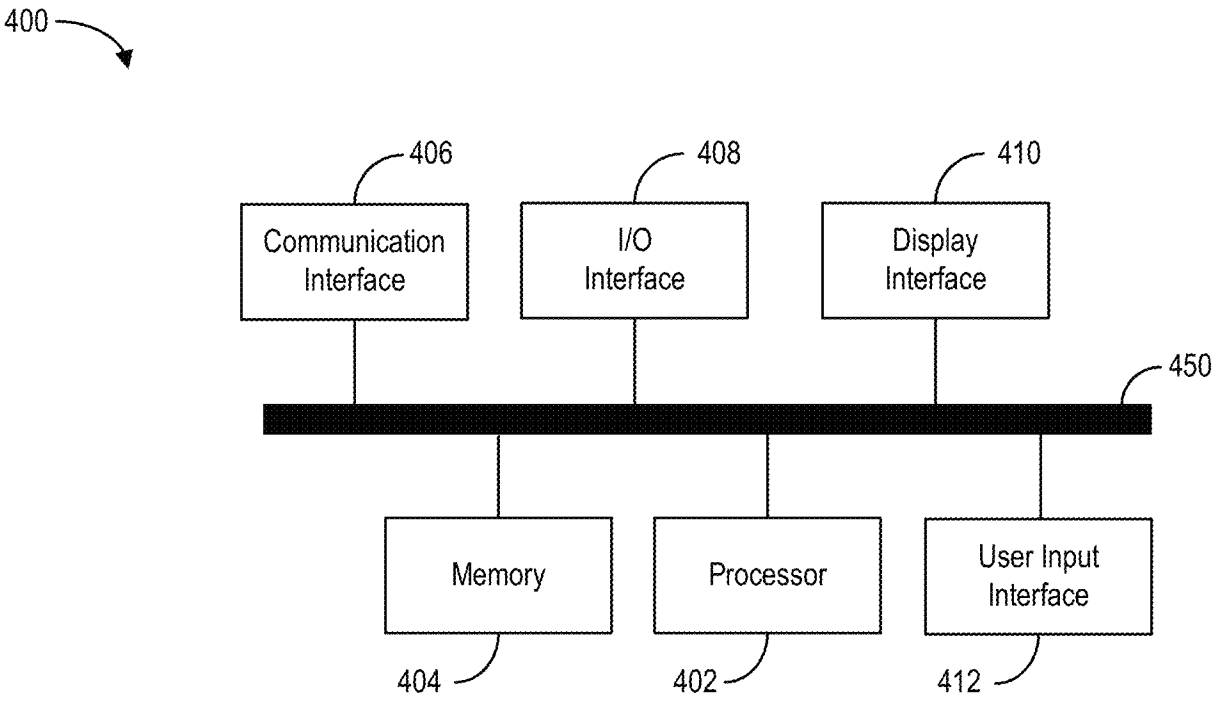
FIG. 4 is a simplified hardware block diagram for an example controller.

Reference is made to FIG. 4, which shows an example hardware configuration for controller (160).

As shown, controller (160) can include processor (402), which is coupled via a data bus (450), to a memory (404). Processor (402) can also couple to one or more of a communication interface (406), input/output interface (408), a display interface (410) and/or a user input interface (412).

As used herein, "processor" refers to one or more electronic devices that is/are capable of reading and executing instructions stored on a memory to perform operations on data, which may be stored on a memory or provided in a data signal. The term "processor" includes a plurality of physically discrete, operatively connected devices despite use of the term in the singular. Non-limiting examples of processors include devices referred to as microprocessors, microcontrollers, central processing units (CPU), and digital signal processors. The term "processor" may be used interchangeably with "at least one processor" and/or "one or more processors".

As used herein, a "memory" refers to a non-transitory tangible computer-readable medium for storing information in a format readable by a processor, and/or instructions readable by a processor to implement an algorithm. The term "memory" includes a plurality of physically discrete, operatively connected devices despite use of the term in the singular. Non-limiting types of memory include solid-state, optical, and magnetic computer readable media. Memory may be non-volatile or volatile. Instructions stored by a memory may be based on a plurality of programming languages known in the art, with non-limiting examples including the C, C++, Python™, MATLAB™, and Java™ programming languages.

It will be understood by those of skill in the art that references herein to controller (160) as carrying out a function or acting in a particular way imply that processor (402) is executing instructions (e.g., a software program) stored in memory (404) and possibly transmitting or receiving inputs and outputs via one or more interfaces.

Communication interface (406) may comprise a cellular modem and antenna for wireless transmission of data to the communications network.

I/O interface (408) can include any interface that accepts inputs or outputs.

In some examples, controller (160) connects to the other components of the systems (100*a*) and/or (100*b*) (e.g., as shown in FIG. 2), via one or more of the communication interface (406) and/or I/O interface (408).

Display interface (410) can be an output interface for displaying data (e.g., an LCD screen).

Input interface (412) can be any interface for receiving user inputs (e.g., a keyboard, mouse, touchscreen, etc.). In some examples, the display and input interface or one of the same (e.g., in the case of a touchscreen display, such as a capacitive touchscreen).

X. Interpretation

Various systems or methods have been described to provide an example of an embodiment of the claimed subject matter. No embodiment described limits any claimed subject matter and any claimed subject matter may cover methods or systems that differ from those described below. The claimed subject matter is not limited to systems or methods having all of the features of any one system or method described below or to features common to multiple or all of the apparatuses or methods described below. It is possible that a system or method described is not an embodiment that is recited in any claimed subject matter. Any subject matter disclosed in a system or method described that is not claimed in this document may be the subject matter of another protective instrument, for example, a continuing patent application, and the applicants, inventors or owners do not intend to abandon, disclaim or dedicate to the public any such subject matter by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It should also be noted that the terms "coupled", or "coupling" as used herein can have several different meanings depending in the context in which these terms are used. For example, the terms coupled, or coupling may be used to indicate that an element or device can electrically, optically, or wirelessly send data to another element or device as well as receive data from another element or device. As used herein, two or more components are said to be "coupled", or "connected" where the parts are joined or operate together either directly or indirectly (i.e., through one or more intermediate components), so long as a link occurs. As used herein and in the claims, two or more parts are said to be "directly coupled", or "directly connected", where the parts are joined or operate together without intervening intermediate components.

It should be noted that terms of degree such as "substantially", "about" and "approximately" as used herein mean a reasonable amount of deviation of the modified term such that the end result is not significantly changed. These terms of degree may also be construed as including a deviation of the modified term if this deviation would not negate the meaning of the term it modifies.

Furthermore, any recitation of numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed.

The example embodiments of the systems and methods described herein may be implemented as a combination of hardware or software. In some cases, the example embodiments described herein may be implemented, at least in part, by using one or more computer programs, executing on one or more programmable devices comprising at least one processing element, and a data storage element (including volatile memory, non-volatile memory, storage elements, or any combination thereof). These devices may also have at least one input device (e.g. a pushbutton keyboard, mouse, a touchscreen, and the like), and at least one output device (e.g. a display screen, a printer, a wireless radio, and the like) depending on the nature of the device.

It should also be noted that there may be some elements that are used to implement at least part of one of the embodiments described herein that may be implemented via software that is written in a high-level computer programming language such as object oriented programming or script-based programming. Accordingly, the program code may be written in Java, Swift/Objective-C, C, C++, Javascript, Python, SQL or any other suitable programming language and may comprise modules or classes, as is known to those skilled in object oriented programming. Alternatively, or in addition thereto, some of these elements implemented via software may be written in assembly language, machine language or firmware as needed. In either case, the language may be a compiled or interpreted language.

At least some of these software programs may be stored on a storage media (e.g. a computer readable medium such as, but not limited to, ROM, magnetic disk, optical disc) or a device that is readable by a general or special purpose programmable device. The software program code, when read by the programmable device, configures the programmable device to operate in a new, specific and predefined manner in order to perform at least one of the methods described herein.

Furthermore, at least some of the programs associated with the systems and methods of the embodiments described herein may be capable of being distributed in a computer program product comprising a computer readable medium that bears computer usable instructions for one or more processors. The medium may be provided in various forms, including non-transitory forms such as, but not limited to, one or more diskettes, compact disks, tapes, chips, and magnetic and electronic storage. The computer program product may also be distributed in an over-the-air or wireless manner, using a wireless data connection.

The term "software application" or "application" refers to computer-executable instructions, particularly computer-executable instructions stored in a non-transitory medium, such as a non-volatile memory, and executed by a computer processor. The computer processor, when executing the instructions, may receive inputs and transmit outputs to any of a variety of input or output devices to which it is coupled. Software applications may include mobile applications or "apps" for use on mobile devices such as smartphones and tablets or other "smart" devices.

A software application can be, for example, a monolithic software application, built in-house by the organization and possibly running on custom hardware; a set of interconnected modular subsystems running on similar or diverse hardware; a software-as-a-service application operated remotely by a third party; third party software running on outsourced infrastructure, etc. In some cases, a software application also may be less formal, or constructed in ad hoc fashion, such as a programmable spreadsheet document that has been modified to perform computations for the organization's needs.

Software applications may be deployed to and installed on a computing device on which it is to operate. Depending on the nature of the operating system and/or platform of the computing device, an application may be deployed directly to the computing device, and/or the application may be downloaded from an application marketplace.

The present invention has been described here by way of example only, while numerous specific details are set forth herein in order to provide a thorough understanding of the exemplary embodiments described herein. However, it will be understood by those of ordinary skill in the art that these embodiments may, in some cases, be practiced without these specific details. In other instances, well-known methods, procedures and components have not been described in detail so as not to obscure the description of the embodiments. Various modification and variations may be made to these exemplary embodiments without departing from the spirit and scope of the invention, which is limited only by the appended claims.

The invention claimed is:

1. A method for oil production, comprising:

operating at least one downhole electric heater to vaporize liquid solvent conveyed into a subsurface formation, the at least one downhole electric heater being operated in a temperature range that is: (i) above the vaporization temperature of the solvent; and (ii) below the steam saturation temperature of the subsurface formation, wherein operating the at least one downhole electric heater produces a mixture comprising oil and solvent, the mixture being further separable to separate the oil from the solvent, such as to produce oil.

2. The method of claim 1, further comprising:

monitoring, using at least one temperature sensor, a bottom hole temperature;

determining if the temperature is within the temperature range; and if the temperature is not in the temperature range, adjusting operation of the at least one electric heater to operate within the temperature range.

3. The method of claim 2, wherein the mixture is separable using a separation subsystem.

4. The method of claim 1, wherein the liquid solvent is conveyed to the subsurface formation through a first conveyance structure, and the mixture is conveyed through a second conveyance structure.

5. The method of claim 4, wherein the first conveyance structure is a first tubing, and the second conveyance structure is a second tubing, and wherein, the first tubing is an inner tubing of an injection well extending into the formation, and the second tubing is an inner tubing of a production well also extending into the formation; or the first and second tubing are part of a single production well, extending into the formation.

6. The method of claim 4, wherein the at least one electric heater is located in one or more of inside and around the first conveyance structure, and at least a portion of the at least one electric heater is located below ground.

7. The method of claim 6, wherein the temperature range is a first temperature range and the at least one electric heater is at least one first electric heater, and an at least one second electric heater is associated with the second conveyance structure, wherein method further comprises:

operating the at least one second electric heater at a second temperature range, the second temperature range configured to minimize cooling-off of the mixture of oil and solvent.

8. The method of claim 1, further comprising:

monitoring, using at least one pressure sensor, a bottom hole pressure;

determining if the bottom hole pressure is within a pre-defined pressure range; and if the bottom hole pressure is not within the pressure range, adjusting operation of at least one of a pumping mechanism and a well head control valve.

9. The method of claim 1, wherein the solvent comprises one or more of aliphatic hydrocarbon solvents and alkane solvents.

10. The method of claim 1, wherein the at least one downhole electric heater is a resistive electric heater.

11. A system for oil production, comprising:

at least one downhole electric heater operable to vaporize liquid solvent conveyed into a subsurface formation, the at least one electric heater operable in a temperature range that is: (i) above the vaporization temperature of the solvent; and (ii) below the steam saturation temperature of the subsurface formation, wherein operating the at least one downhole electric heater in the subsurface formation produces a mixture comprising oil and solvent, the mixture being further separable to separate the oil from the solvent, such as to produce oil.

12. The system of claim 11, further comprising a separation subsystem for receiving the mixture, and separating the oil from the solvent.

13. The system of claim 11, further comprising at least one temperature sensor coupled to at least one processor, the at least one processor being further coupled to the at least one electric heater, the at least one processor being configured for:

monitoring, via the at least one temperature sensor, a bottom hole temperature;

determining if the temperature is within the temperature range; and if the temperature is not in the temperature range, adjusting operation of the at least one electric heater to operate within the temperature range.

14. The system of claim 11, wherein the liquid solvent is conveyed through a first conveyance structure, and the mixture is conveyed through a second conveyance structure.

15. The system of claim 14, wherein the first conveyance structure is a first tubing, and the second conveyance structure is a second tubing, wherein, the first tubing is an inner tubing of an injection well extending into the formation, and the second tubing is an inner tubing of a production well also extending into the formation; or the first and second tubing are part of a single production well, extending into the formation.

16. The system of claim 14, wherein the at least one electric heater is located inside and/or around the first conveyance structure.

17. The system of claim 16, wherein the temperature range is a first temperature range and the at least one electric heater is at least one first electric heater, and an at least one second electric heater is associated with the second conveyance structure, wherein the at least one processor is further configured for:

operating the at least one second electric heater at a second temperature range, the second temperature range configured to minimize cooling-off of the mixture of oil and solvent.

18. The system of claim 11, further comprising at least one pressure sensor coupled to at least one processor, and the at least one processor is configured for:

monitoring, via the at least one pressure sensor, a bottom hole pressure;

determining if the bottom hole pressure is within a pre-defined pressure range; and if the bottom hole pressure is not within the pressure range, adjusting operation of at least one of a pumping mechanism and a well head control valve.

19. The system of claim 11, wherein the at least one electric heater is a resistive electric heater.

20. The system of claim 11, wherein the solvent comprises one or more of aliphatic hydrocarbon solvents and alkane solvents.

* * * * *